US005092779A

United States Patent [19]

Piwonka et al.

[11] Patent Number: 5,092,779

[45] Date of Patent: Mar. 3, 1992

[54] ACADEMIC QUIZ CONTROLLER

[76] Inventors: Dennis F. Piwonka, Rte. 5, Box 204, Caldwell, Tex. 77836; Gregory S. Schreiber, 817 S. Waverly, Mt. Prospect, Ill. 60056

[21] Appl. No.: 483,078

[22] Filed: Feb. 21, 1990

[51] Int. Cl.[5] ..... A63F 9/00

[52] U.S. Cl. ..... 434/352; 273/433

[58] Field of Search ..... 434/352, 323, 336; 273/430, 433, 237, 455

[56] References Cited

U.S. PATENT DOCUMENTS

| | | | |
|---|---|---|---|
| 2,562,179 | 7/1951 | Dorf . | |
| 2,654,163 | 10/1953 | Reynolds . | |
| 3,113,236 | 1/1964 | Hemel . | |
| 3,491,464 | 1/1970 | Gray . | |
| 3,666,873 | 5/1972 | Pincus . | |
| 3,763,577 | 10/1973 | Goodson . | |
| 3,852,894 | 12/1974 | Ryland . | |
| 4,079,365 | 3/1978 | Yamauchi . | |
| 4,261,563 | 4/1981 | Goldfarb | 273/433 |
| 4,285,517 | 8/1981 | Morrison et al. | 273/433 |
| 4,322,073 | 3/1982 | Shuik et al. | 273/433 |
| 4,372,554 | 2/1983 | Orenstein . | |
| 4,593,904 | 6/1986 | Graves | 434/323 X |
| 4,625,244 | 11/1986 | Chong et al. . | |
| 4,764,120 | 8/1988 | Griffin et al. . | |
| 4,767,335 | 8/1988 | Curt . | |
| 4,793,813 | 12/1988 | Bitzer et al. . | |
| 4,895,364 | 1/1990 | Martel et al. | 273/237 X |

*Primary Examiner*—Richard J. Apley
*Assistant Examiner*—Glenn E. Richman
*Attorney, Agent, or Firm*—Dean A. Monco

[57] ABSTRACT

A quiz controller for developing a time-ordered list of contestant responses. A microprocessor-based main unit is in electronic communication with one or more players interfaces. Each player interfaces may have up to eight contestant pushbuttons. The main unit includes a digital display on a front panel and a digital display on a back panel. The main unit also includes four control pushbuttons which control two timers, the contestant display, and clearing the system. The control pushbuttons also may be used to reset the parameters of the game.

24 Claims, 9 Drawing Sheets

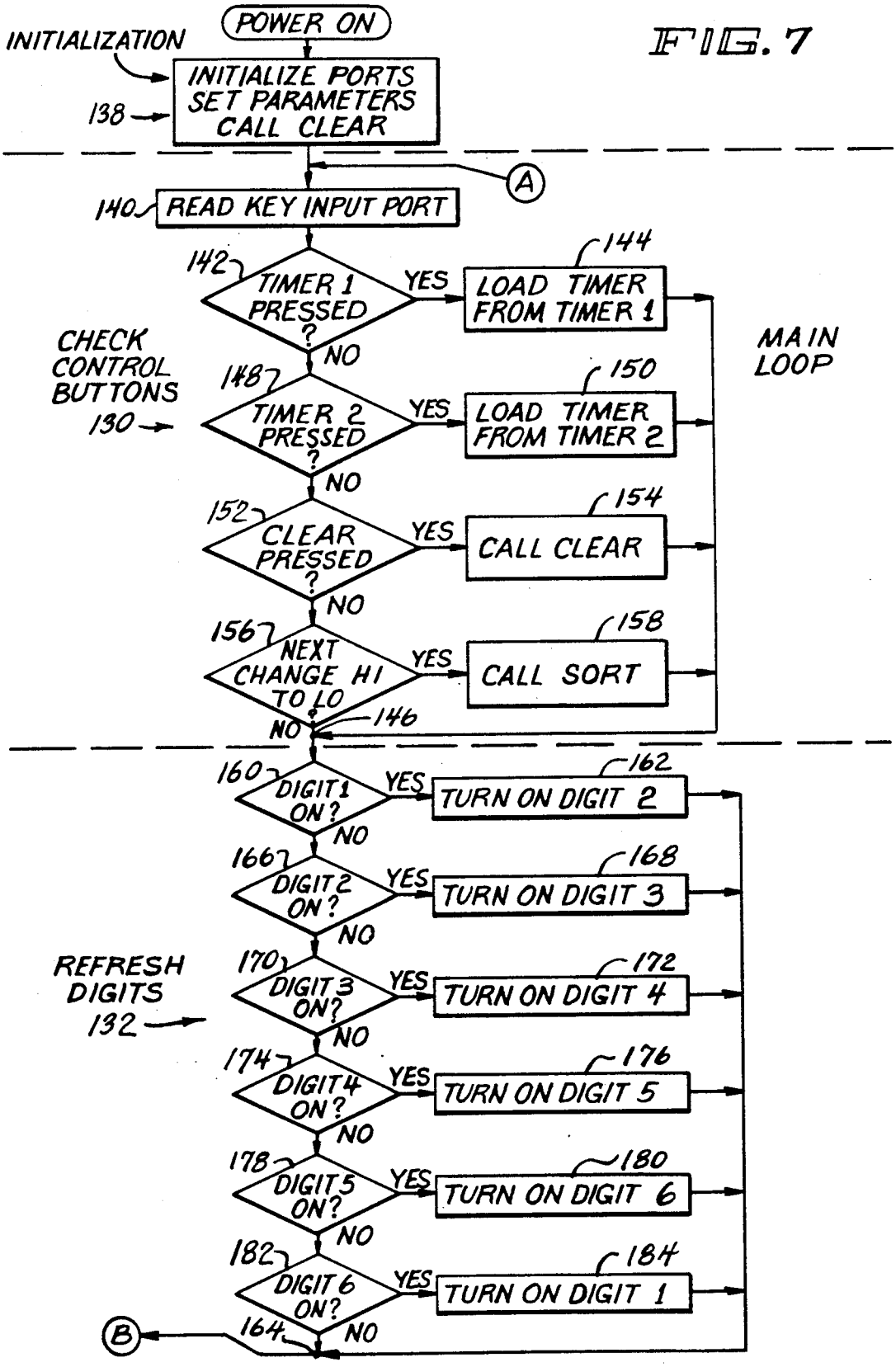
FIG. 7
INITIALIZATION
POWER ON
INITIALIZE PORTS
SET PARAMETERS
CALL CLEAR
138
A
140
READ KEY INPUT PORT
142
TIMER 1 PRESSED ?
YES
144
LOAD TIMER FROM TIMER 1
NO
CHECK CONTROL BUTTONS
130
148
TIMER 2 PRESSED ?
YES
150
LOAD TIMER FROM TIMER 2
NO
MAIN LOOP
152
CLEAR PRESSED ?
YES
154
CALL CLEAR
NO
156
NEXT CHANGE HI TO LO
YES
158
CALL SORT
NO
146
160
DIGIT 1 ON ?
YES
162
TURN ON DIGIT 2
NO
166
DIGIT 2 ON ?
YES
168
TURN ON DIGIT 3
NO
REFRESH DIGITS
132
170
DIGIT 3 ON ?
YES
172
TURN ON DIGIT 4
NO
174
DIGIT 4 ON ?
YES
176
TURN ON DIGIT 5
NO
178
DIGIT 5 ON ?
YES
180
TURN ON DIGIT 6
NO
182
DIGIT 6 ON ?
YES
184
TURN ON DIGIT 1
NO
B
164

SHIFT SUBROUTINE

SORT SUBROUTINE

CLEAR SUBROUTINE

ACADEMIC QUIZ CONTROLLER

FIELD OF THE INVENTION

This invention relates generally to the field of academic quizzes, and, more specifically, to an academic quiz controller which stores and selectively displays a time-ordered list of contestant responses, indicating a desire to answer a question.

BACKGROUND OF THE INVENTION

Academic quizzes or contests have been used for many years, both as entertainment and as teaching aids. Quiz contests help to reinforce factual knowledge and recall of students or contestants and at the same time can be a fun activity. The format of most academic quizzes and contests is fairly universal. In general, a judge or moderator asks a question which a plurality of contestants attempt to answer. The first player who successfully answers the question is generally awarded points of some kind, and the player who has the most points at the end of the competition wins. Therefore, when a contestant wishes to attempt to answer the question, the contestant signals the moderator in some fashion, and the moderator must determine who signaled first.

The first contestant to signal has the first chance to answer the question. The contestants may compete against each other individually, or may be in teams. In team competition, normally only one contestant per team may attempt to answer a question, before the other team or teams may try. There may also be a limited time in which a question may be answered.

To orderly administer a quiz or game of this type, the moderator must be able to determine which contestant first signaled that he or she wanted to attempt to answer the question. If a contestant answered the question incorrectly, the moderator must determine which contestant signaled second, etc. In the past, the moderator had to read the questions again and determine which of the remaining teams/individuals signaled first.

For example, Curt U.S. Pat. No. 4,767,335, and the references cited therein, disclose various academic quiz controllers. Curt, which is believed to be the most sophisticated of the prior art, discloses a computerized academic quiz controller with a master console and a plurality of contestant modules interconnected by telephone cables and modular telephone connectors. The modules are grouped into teams, illustratively two teams of four contestants each. In Curt, there are several modes of operation, including a quiz or "toss-up" mode. In this mode, after one contestant on one team signals that he or she wishes to answer a question, all of the other teams are "locked-out," that is, the modules on the other team are rendered inoperative. If the first contestant answers the question incorrectly there is no means to determine which, if any, other contestant was second, third, etc. Furthermore, there does not appear to be any way to increase the number of teams or, conversely, utilize the invention of Curt in individual play.

Therefore, it is a general object of the invention to provide a quiz controller which overcomes the limitations of the prior art.

It is a further object of the invention to provide a quiz controller that is easily modified for variations in the rules of play.

It is a further object of the invention to provide a quiz controller that can be varied from individual play to teams of varying sizes.

SUMMARY OF THE INVENTION

According to this invention, a microprocessor-based control module is in electronic communication with one or more player interfaces. Each player interface may have preferably up to eight contestant pushbuttons operatively connected thereto. The control module includes a front and a rear panel with digital displays on each. The control module includes four control pushbuttons which control two timers, the content of the contestant display, and clearing the system. The control pushbuttons also may be used to reset certain parameters of the game.

Play begins when a moderator reads a question. The moderator may then optionally activate a first timer. Contestants press pushbuttons in order to signal that they wish to attempt to answer the question, and the control module records which contestant pushed his or her pushbutton first, which contestant was second, etc., and develops a time-ordered list of responses. The contestant and/or team number of the first contestant to press the pushbutton is displayed. The moderator optionally activates a second timer and the first contestant has a preselected time in which to answer the question. If the first contestant does not answer the question correctly, the moderator may then cause the contestant number of the second contestant to be displayed. This continues until the question is answered correctly or no further contestants wish to attempt to answer. The moderator then clears the control module and asks another question.

BRIEF DESCRIPTION OF THE DRAWINGS

The invention, together with its objects and the advantages thereof, may best be understood by reference to the following detailed description taken in conjunction with the accompanying drawings of which.

DETAILED DESCRIPTION OF THE PREFERRED EMBODIMENT

General Description of the Main Modules

Figures 1, 1A:
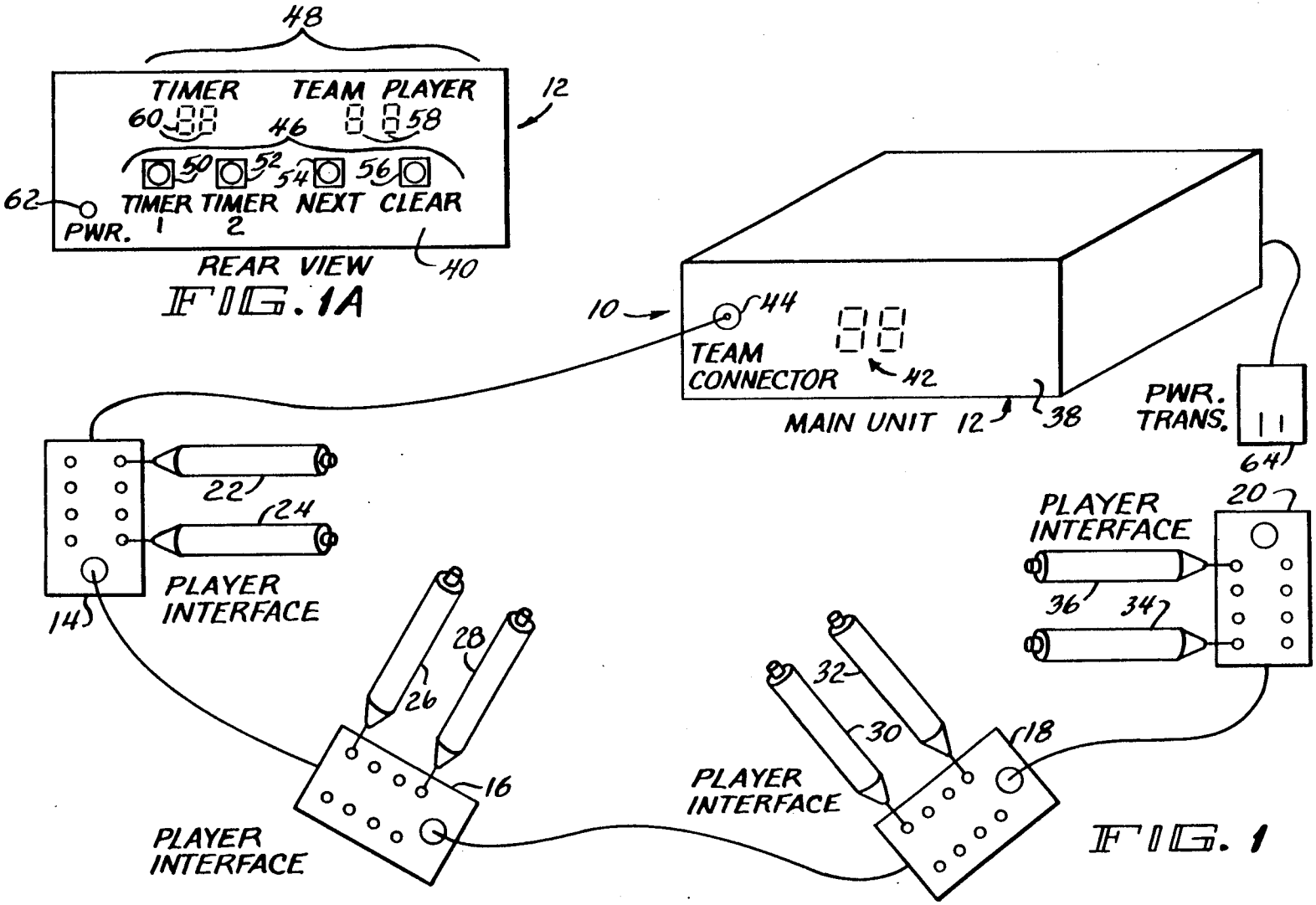
FIGS. 1 and 1*a* are perspective illustrations of the interconnected modules of the preferred embodiment of this invention.

FIG. 1 is an illustration of the main modules of the preferred embodiment of this invention. The quiz controller of this invention is shown generally at 10. As seen in the illustration of FIG. 1, the main components of this embodiment of this invention include a main unit or housing 12, interface modules 14, 16, 18 and 20 and contestant pushbuttons, illustratively 22–36.

The main unit 12 is operated by a moderator or judge who controls the play of the game. The contestant pushbuttons 22–36 are activated by contestants when the contestants want to attempt to answer a question. The main unit includes a front panel 38 and a rear panel 40, illustrated in FIG. 1A.

The front panel 38 of the main unit 12 includes two LED or LCD displays 42, as are known in the art. These displays, as will be described further below, display the number of the team and the player number on that team, or, alternatively, the individual number of the player who is permitted to attempt to answer the toss up question. Also located on the front panel 38, in the preferred embodiment, is a modular plug connector 44 which operatively connect the main unit to the player interface modules 14–20.

Turning to FIG. 1A, an illustration of the rear panel 40 of the main unit 12 is shown. The rear panel 40 includes four control pushbuttons, collectively 46, and four LCD or LED displays 48. The control pushbuttons 46 are used by the moderator to control the main unit 12, and the displays 42 and 48, and to change certain parameters of the game as will be described below. The four control pushbuttons 46 comprise, in the preferred embodiment, "Timer 1" 50, "Timer 2" 52, "Next" 54, and "Clear" 56. A first two displays 58 of the rear panel 40 display player/team as described above, and a second two displays 60 on the rear panel 40 display a count-down timer in seconds, and will be described below.

A modular power jack 62 operatively connects a power transformer 64, to the main unit 12. The power transformer converts 110 v 60A AC to +5 v DC, as is known in the art.

Play of the Game

Playing the game in the preferred embodiment of this invention proceeds generally according to the rules of The Illinois Science Bowl, which is one event in the Illinois Science Olympiad. Other rules could be incorporated easily without departing from the scope of this invention. The contestants are generally divided up into three teams of four contestants each. However, as will be described hereinbelow, contestants may compete against each other individually, or on teams of 4, 5, 6 or 8 contestants each.

To initiate play of this game, the moderator verbally asks a question. Optionally, the moderator may press the Timer 1 50 control pushbutton to initiate a count-down timer of a predetermined number of seconds, which will be displayed on the rear panel display 60. The contestants must signal a desire to answer the question before the expiration of the time. If a contestant wishes to attempt to answer the question, he or she presses his or her respective contestant pushbutton 22–36. The number of the team and contestant that first pressed a contestant pushbutton will, in the preferred embodiment, then be displayed by the main unit 12 on the front panel display 42, and the rear panel display 58.

In team play, once one contestant on a team presses a contestant pushbutton, other contestants on the same team are locked out or blocked from signaling that they want to attempt to answer the question. If the contestants are competing individually, only the contestant number will be displayed in display 42 and 58.

The moderator optionally may then press the timer 2 pushbutton 52, which again initiates a timer which counts down in seconds and is displayed on rear panel display 60. This second time period may be the time in which the contestant must answer the question in the preferred embodiment.

If the first contestant did not answer the question correctly, or the timer timed-out, the moderator may then cause the main unit 12 to display the number of the second or "next" contestant who pressed his or her respective contestant pushbutton by pressing the "next" control pushbutton 54. The game continues as above until one of the contestants answers the question correctly or until no contestants are left who indicate a desire to respond. The moderator then clears the main unit 12 by pressing the "clear" control pushbutton 54, and asks another question.

System Hardware

Figure 2:
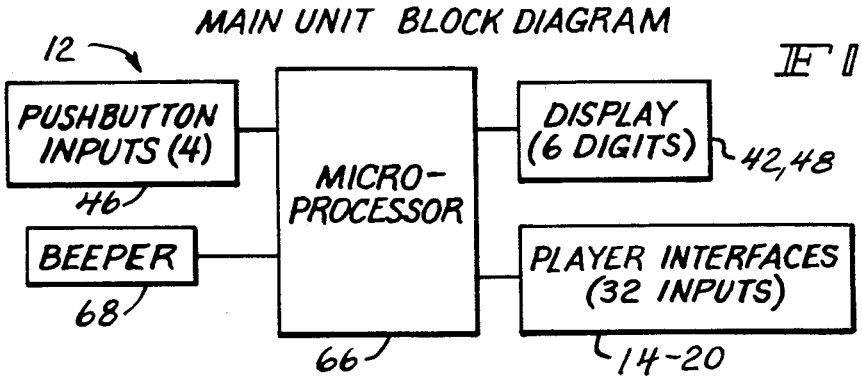
FIG. 2 is a block diagram of the main internal components of the main unit of the preferred embodiment of this invention.

FIG. 2 is a block diagram of the major components of the main unit 12. The main unit 12 in the preferred embodiment includes a microprocessor 66. Operatively connected to the microprocessor 66 as inputs are control pushbuttons 46, and the player interfaces 14–20 as will be described hereinafter below. Operatively connected to the microprocessor 66 as outputs are a beeper 68 and the front and rear panel displays 42 and 48 respectively. Also operatively connected to the microprocessor 66 is the power transformer 64 (not shown for clarity in this illustration) which is readily available and known in the art.

The Microprocessor

The microprocessor 66 in the preferred embodiment of the current invention is an Intel 8048 microprocessor available from the Intel Corporation of Santa Clara, Calif. This microprocessor 66 has been selected for the preferred embodiment because it includes 64 bytes of random access memory (RAM) and 1k (1024 bytes) of read only memory (ROM). The operational software of the preferred embodiment will be stored in the ROM, and uses the RAM for temporary variable storage, as known in the art, and described below.

Alternatively, similar microprocessors are available from most major manufacturers. Other types of microprocessors with or without on-board memory may be used, depending upon the particular application, without departing from the scope of this invention. For example, a similar microprocessor could be used with external RAM and/or external ROM. External ROM might be preferred in applications where the operational software program may be changed frequently. Instead of ROM, the operational software programs may also be stored in other forms of memory as are known in the art (such as floppy or hard disk) or hereinafter invented, without departing from the scope of this invention.

The Intel 8048 also includes a counter/timer which may be used as an internal clock for timing applications or for counting events. There are 27 input/output pins or connectors available on the Intel 8048 microprocessor for interfacing the microprocessor 66 to external circuitry. These output pins are organized into ports as known in the art, and may be designated "input" or "output" ports by the application program, which may divide the ports to be partially input and partially output. The ports of the microprocessor used in the preferred embodiment of this invention include Port 1, Port 2 and the Bus Port. Each port comprises 8 bits.

Port 1 is divided up into 5 input bits and 3 output bits. The control pushbuttons 46 and a data lead from the player interfaces 16-20 appear as inputs to Port 1. The beeper control, and a clock and load signals which appear as outputs form Port 1 in the preferred embodiment. Port 2 is used as an output port in the preferred embodiment to turn on the six digit displays 42, 48, as will be described below. The bus port is used in conjunction with Port 2, and outputs a binary-coded-decimal number to the currently-on digit display as known in the art and described further below.

Figure 3:
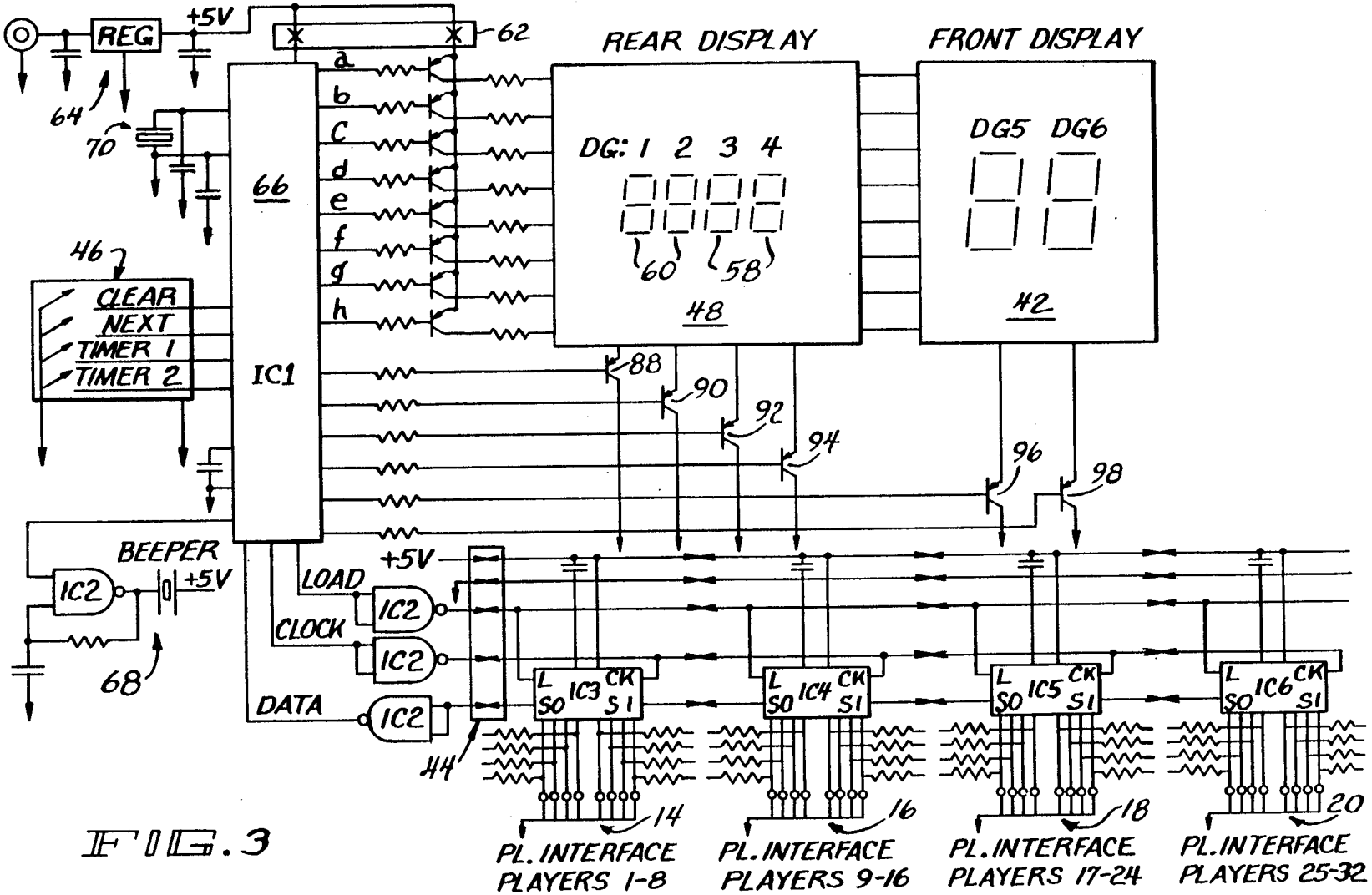
FIG. 3 is a schematic diagram of the main components of the preferred embodiment of this invention.

Turning now to FIG. 3, a schematic diagram of the preferred embodiment of the main unit is shown, illustrating the major components of the main unit. A power supply is shown at 64, which is connected to the main unit at 62. The power supply provides a regulated +5 volt electrical supply to the main components of the system. Such power supplies are common and well known in the art.

A clock crystal 70 is operatively connected to the microprocessor 66, as known in the art. In the preferred embodiment the clock crystal provides a 4.9152 MHz signal. In this embodiment, a 4.9152 MHz signal causes the counter/timer of the Intel 8048 microprocessor to overflow approximately 40 times a second, which will be used to time several features of this invention, as described below. If other processors are used, other clock crystals may be employed without departing from the scope of this invention.

Control Pushbuttons

In box 46, four control pushbuttons are shown. The control pushbuttons comprise momentarily-on normally-off switches as are known in the art. In this embodiment, the control pushbuttons are used to clear the system ("clear" 56), cause the number of next player to be displayed ("next" 54), turn on a first timer ("timer 1" 50), and turn on a second timer ("timer 2" 52). The control pushbuttons are also used to change certain parameters of the game.

In the preferred embodiment the amount of time in Timer 1 and Timer 2 and the number of players on a team may be varied by using the control pushbuttons. To change the amount of time in either timer, the respective timer button is pressed for four seconds. After four seconds, when the "clear" 56 button is simultaneously pressed, the amount of time in the timer increments by one second. After 99 seconds, the timer wraps around to 1 in the preferred embodiment. To change the number of players per team, the "next" 54 button is pressed for four seconds, in conjunction with the "clear" 56 button. The number of players per team may be selected from 1, 4, 5, 6 and 8 in the preferred embodiment. These team sizes were selected for this embodiment for simplicity in software design. Other team sizes may be employed without departing from the scope of this invention.

Beeper

An audible transducer is shown at 68. The audible transducer of this embodiment comprises a beeper and is operationally connected to one pin of the microprocessor's output port 1. Beeper 68 is preferably part of a 4093 Quad Nand Gate with Schmidt trigger chip. The microprocessor output to the beeper is programmed during initialization to be normally at a logical low, resulting in the oscillator being off. When the system software indicates a sound to be made, the output is made high, as is known in the art and will be described below, enabling the beeper oscillator resulting in an audible sound. The use of the audible sound is also described below.

Displays

Continuing with FIG. 3, two sets of displays are shown at 42 and 48. In this preferred embodiment, there is a front display 42 on the front panel 32 of the main unit 12, which is visible primarily to the contestants. There is a rear display 48 on the back panel 40 of the main unit 12, which is visible primarily to the moderator. The front display 42 shows the number of the team and/or contestant who may answer the question. The rear display 48, in addition to showing the number of the team and/or contestant who may answer the question, shows the time, if any, remaining on the timer.

The digit displays comprise, in the preferred embodiment, six eight-segment displays. The front panel displays comprise two HDSP-3403 and the rear panel displays comprise four 5082-7760, manufactured by Hewlett Packard Corporation of Palo Alto, Calif., or the equivalent. The output information to the six digits of the displays is multiplexed, in the preferred embodiment. The digit to be displayed is converted from binary-code decimal by an algorithm known in the art and written to the bus port. Subsequently, the digit display is turned on by a bit pattern being written to port 2. This provides a six digit display with a minimal amount of real-time overhead.

The LCD or LED segment data information may be output on the microprocessor's bus port, labeled "a-g" and "dp" in FIG. 3, and the individual digit display may be turned on by six pins of the microprocessor's port 2 labeled "digit 1-6." The bus port is programmed at initialization, as is known in the art, and provided by the microprocessor instruction set, to be normally high, resulting in all digits being "off." As each digit is to be displayed, the numerical value to be displayed is converted from binary coded decimal (BCD) and loaded into the eight bits of the bus port, as is understood in the art.

Each bit of the bus port, labeled a-g and dp is operatively connected to the base of transistors 72-86. When a bit or signal is present on the bus line a-g and dp, the respective transistor 72-86 will turn on, thus causing a segment of the display to illuminate. Simultaneously, or nearly simultaneously, the electrical power to the digit is turned on by writing the appropriate bit pattern to port 2. The bit pattern in port 2 causes the respective transistor 88-98 to turn on, as is known in the art.

Figure 4:
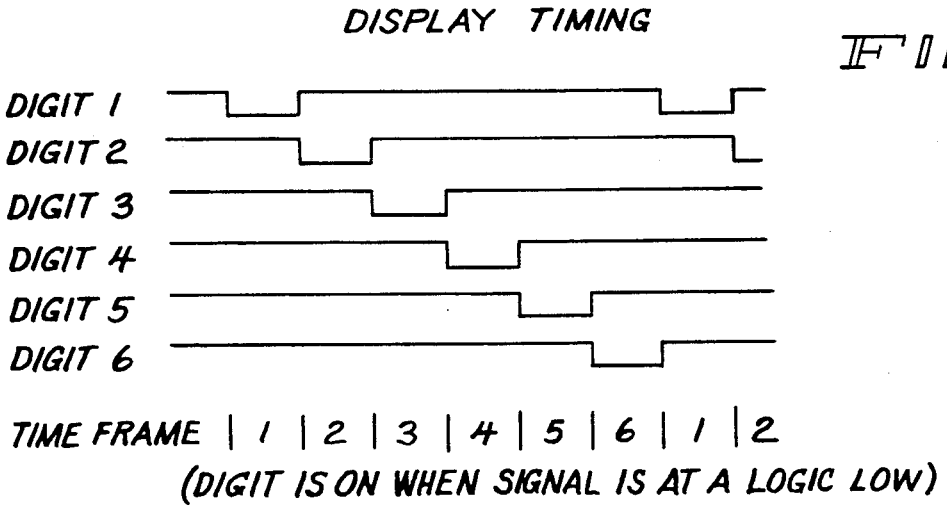
FIG. 4 is a timing diagram of the display timing of the preferred embodiment of this invention.

Referring now to FIG. 4, a timing diagram for the display timing is shown. At initialization, the six leads of port 2 are set to be normally high, as known in the art. The six leads of port 2 are operationally connected to transistors 88-98, as known in the art. As the software cycles through its main loop (described below), it periodically causes the normally-high signal to become a logical low by writing an appropriate bit pattern to port 2. As a result, the system turns on one digit at a time. The "on" time is approximately 2 milliseconds in this embodiment, then the selected digit is off for 10 milliseconds while the five other digits are sequentially turned on. The entire cycle takes approximately 12 milliseconds. As a result, each digit is on about 80 times per second. This happens relatively fast in real time, so that generally no flickering is visible to the human eye.

Player Interfaces and Contestant Pushbuttons

Figure 5:
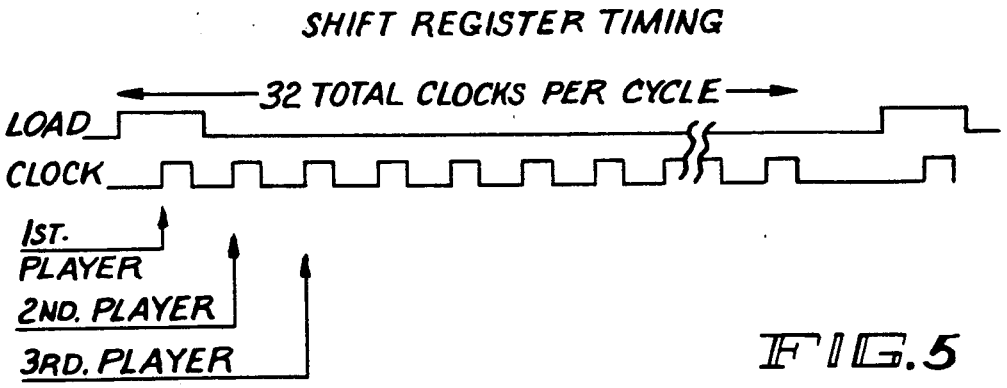
FIG. 5 is a timing diagram of the shift register timing in the preferred embodiment of this invention.

The player interfaces of this invention will be described in connection with FIGS. 1, 3 and 5. Turning first to FIG. 1, the illustration of the Quiz Controller System built according to the preferred embodiment of this invention, the player interfaces are shown at 14–20. Generally, the player interface comprises four modular boxes 14–20 operatively connected to 32 momentarily-on, normally-off contestant pushbuttons 22–36 in the preferred embodiment. The contestant pushbuttons 22–36 are connected to the player interfaces via individual, modular pairs of wires, as is known in the art. There may be up to eight contestant pushbuttons connected to each player interface in the preferred embodiment. A minimal configuration of the Quiz Controller system may include one player interface 14 with four to eight contestant pushbuttons. Each player interface 14–20 comprises a separate box or case with modular wire connectors to the contestant pushbuttons and each other as known in the art. The modular wire connectors provide power and the communication lines as will be described below, and are connected serially in the preferred embodiment.

Each player interface includes a 4014 8-bit parallel to a serial shift register in the preferred embodiment, with each contestant pushbutton comprising one parallel input to the shift register. The player interfaces are serially interconnected such that the shift-in pin of one unit (for example 16) is connected to the shift-out pin of the subsequent unit (for example 14). The shift-out (SO) pin of the first player interface 14 is connected to a data input pin of port 1 (labelled "Data") of the microprocessor via a NAND gate, as known in the art. The shift registers respond to "Load" and "Clock" signals, which are outputs of port 1 as described above, and are also delivered to NAND gates as known in the art. All four NAND gates are part of one chip, as known in the art and described above in connection with the beeper.

In order to record the order of contestant responses, the microprocessor 66 scans all contestant pushbuttons approximately every 2 milliseconds in the preferred embodiment. Turning now to FIG. 5, a timing for the shift register is shown. A normally low load signal is generated by the microprocessor, and delivered to the load line (FIG. 3), which is delivered to each player interface 14–20. When the normal-low load signal is made high by the software, the player interfaces latch the state of the contestant pushbuttons into the shift register. Each contestant pushbutton is represented by a bit. If a contestant pushbutton is pressed, a logical "0" is latched in the shift register, otherwise a logical "1" is latched.

When the shift registers are latched, the first bit of each shift register is available at the shift out pin of each respective player interface, and the first bit of the first shift register (corresponding to the state of player 1's pushbutton) is available at the data port. As the "clock" signal changes from low to high, all of the bits in all of the shift registers are shifted one position toward the microprocessor 66, as known in the art. The utilization of this bit of information will be described below, in connection with FIG. 8.

The preferred embodiment of this invention uses a minimum of computer hardware and is flexible enough to be used in many quiz game formats. This flexibility is made possible by implementing aspects of this invention in software. The software will be described in connection with FIGS. 6 through 10 which include a memory layout and software flow charts.

SYSTEM SOFTWARE

The Intel 8048 microprocessor 66 of the preferred embodiment incudes 64 bytes of random access memory (RAM), and 1024 bytes of read-only memory (ROM). The system operational software is stored in the ROM and is implemented in Intel 8048 Assembler, in the preferred embodiment.

Figure 6:
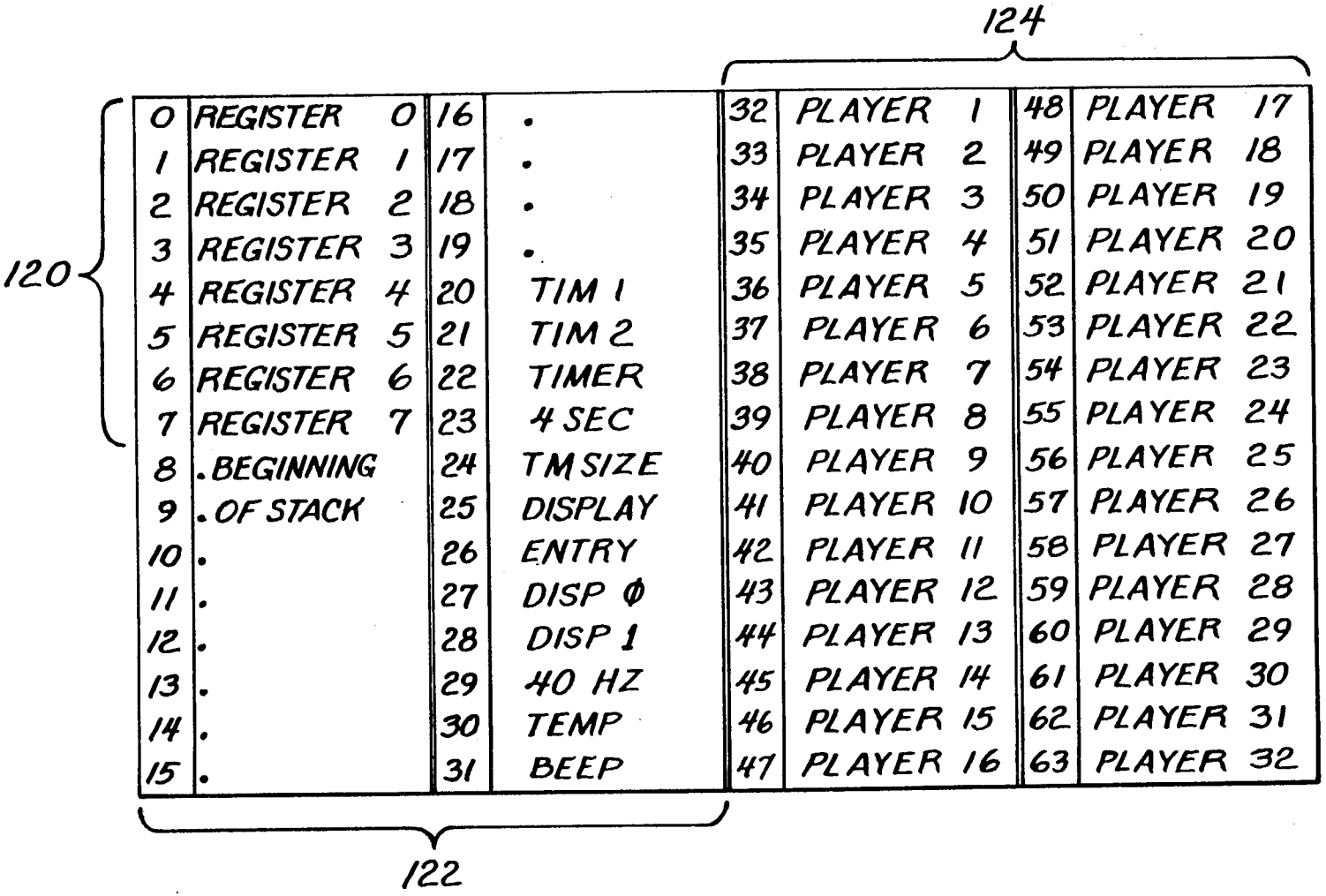
FIG. 6 is a memory map of the random access memory of the preferred embodiment of this invention.

Turning now to FIG. 6, a memory map of the RAM is shown. In the preferred embodiment this invention, there are 64 bytes (that is, 64 8-bit memory locations) in the RAM. In FIG. 6 these memory locations are labeled 0–63 as is common in the computer science art. Of these 64 memory locations, memory locations 0–19 (bracketed as 120) are used by the CPU for operational purposes. Locations 20–31 (bracketed as 122) are used by the software for storing global variables, as will be described below. Storage locations 32–63 (bracketed as 124) are used to develop a time-ordered list of contestants who pressed their respective contestant pushbuttons, as will also be describes hereinbelow.

Of the 19 memory locations used for microprocessor control 120, the first 8 location, 0–7, are used as general purpose registers, as known in the art. Two of these eight registers are used for addressing other memory locations, that is, used as indexes or pointers. The other six registers are used as counters to control software loops or for other temporary variable data, as known in the art.

Memory locations 8–19 are used as a small stack. These memory locations 8–19 are used to store program variables and return information when there is a call to a subroutine, as is known in the art. It is anticipated that only twelve bytes will be needed for the maximum number of subroutines calls in this program. Other implementations may require more or less stack space, depending on the implementation.

The next twelve bytes of memory, 20–31, are used to store variables used in the operation of the game. The first three, 20, 21, and 22, are used to store a timer value and the two possible variable values which may be used as timers. Tim1, which is stored in 20, is the value corresponding to Timer 1. When the Timer 1 control button 50 is pressed the value in Tim1 is transferred to the memory location timer 22. When the Timer 2 button is pressed the value in Tim2, 21, is transferred to the memory location Timer 22. The value in Timer 22 is decremented at a one second interval and is displayed on the rear panel displays 60. When the value in Timer 22 reaches zero, the beeper is turned on. Timer 22 is only set to a nonzero value when one of the timer buttons is pressed. The values in Tim1 20, or Tim2 22, can be changed in the set up portion of the program, described below. When the system is initialized, Tim1 is set to 10 and Tim2 is set to 5 from values stored in the ROM, as is known in the art.

The variable 4 sec 23 is used to keep track of how long the control pushbuttons 46 have been held down. If a control button (Timer 1 50, Timer 2 52, or Next 54) has been held down for four seconds, the parameter associated with the button being held down can be modified by holding down the clear button 56, as will be described further below.

The variable TMsize 24 is used to store the size of the team, and can be modified. TMsize 24 can be modified in the set up portion of the program when the Next button 54 is held down for four seconds. TMsize 24 is set to 4 when the system is initialized from a value stored in ROM, as is known in the art.

The variable Display 25 is used by the sort subroutine to display the time-ordered list. The numerical value in Display is the order number of the "next" contestant to have a chance to answer the question. When the system is initialized or the Clear button is pressed, Display is set to 1, so that the "next" player to be displayed is the first player to press a contestant pushbutton. When the first player is displayed, the value in the variable Display is incremental to "2". In operation, when the Next button 54 is pressed and not held for four seconds the system software sorts through the player memory 124 (memory locations 32–63) for a match with the value in Display. If the values in a player's memory location and display are equal, the player number of that player is displayed on displays 42 and 58. After a match is found, the value in Display is incremented, so that when the Next button 54 is pressed again, the sort sub-routine will scan the player memory for the next player to display.

The variable Entry 26 is used by the shift subroutine to develop a time-ordered list representing the order in which the contestant pressed their respective pushbuttons. When the system is initialized or the Clear button is pressed, the value in Entry is set to 1. When the software program detects that a player has pressed his or her contestant pushbutton, the order number in Entry is stored in a memory location assigned to that player, and the value in entry is incremented. As a result, the first player to press his or her contestant pushbutton has a value of "1" stored in his or her memory location, the second player has a value of "2," etc.

The variables DISP0 27 and DISP1 28 are used to store numbers that are to be displayed on the front and rear digital displays. As is common in computer science, all numbers used are in binary. Therefore, the binary value is converted to two binary-coded decimal (BCD) values, as known in the art. BCD values are stored in DISP0 and DISP1. The value in Timer 22 is converted from binary to BCD and stored in DISP1. The BCD value of the numerical number of the player to be displayed as determined the sort subroutine is converted to team player (or player if the team size is one) and stored in DISP0. The digit refresh portion of the program uses the BCD values from DISP0 for displaying on "team" and "player" digits 42 and 58. The value from DISP1 is used for displaying on the timer digits 60.

The variable 40HZ 29 is used as an internal counter for keeping track of seconds. The internal counter/timer of the microprocessor 66 is incremented by a signal derived from the 4.9152 MHz crystal. In this preferred embodiment, the counter overflows 40 times a second. Each time the counter overflows, the variable 40HZ is incremented and, when it equals 40, one second has elapsed. The variable 40HZ is used in incrementing 4sec and decrementing TIMER.

The variable TEMP 30 is used to store the binary value of the input keys, that is Timer 1, Timer 2, Next, and Clear. As these input keys appear as a binary value in the input portion of port 1, the value at this port is compared to the value stored in TEMP in an effort to debounce the mechanical contacts of the control pushbuttons, as known in the art. The value read at Port 1 is then stored in TEMP for the next pass.

The variable BEEP 31 is used to store the value of the duration of the audible beep. When the shift subroutine (as will be described herein below) senses a player response or when the timer reaches zero, a value is loaded into BEEP 31 and a predefined value is written into port 1, which activates the oscillator, as described above. While BEEP is greater than zero, the beeper signal is turned on. In the service timers subroutine (as will be described in connection with FIG. 7), the BEEP value is decremented every time the timer overflows. When the value in BEEP reaches zero, the beeper signal is turned off by writing a separate predefined value into port 1. As a result, the beeper is on for $\frac{1}{4}$ to $\frac{1}{2}$ of a second.

The memory locations 32–63 are used to store the time order of player responses. Each player has an assigned memory location. Each memory location corresponds to a player pushbutton; in this embodiment memory locations 32–63 correspond to contestant pushbuttons 1–32, respectively (FIG. 3). As the player pushbuttons are scanned by the shift subroutine, the corresponding player memory location is also accessed. If a player pushbutton is found to be a logical high (or 1), the player's memory location is checked for a nonzero value. If the memory location is zero then the value in "Entry" is placed in that player's memory location, thus designating that player's order in the time-ordered list, as will be described below. If the player's memory location is nonzero it is skipped. In other embodiments, if more memory is available more players could be added to this system without departing from the scope of this invention.

Operating Software

The following description of the system software is given with reference to FIGS. 7–10 which are flow charts describing the steps of the program as implemented in this embodiment of this invention. This embodiment of this invention is written in the Intel 8048 Assembly language for speed in execution. Other high or low level programming languages may be used without departing from the scope of this invention.

Figure 7A:
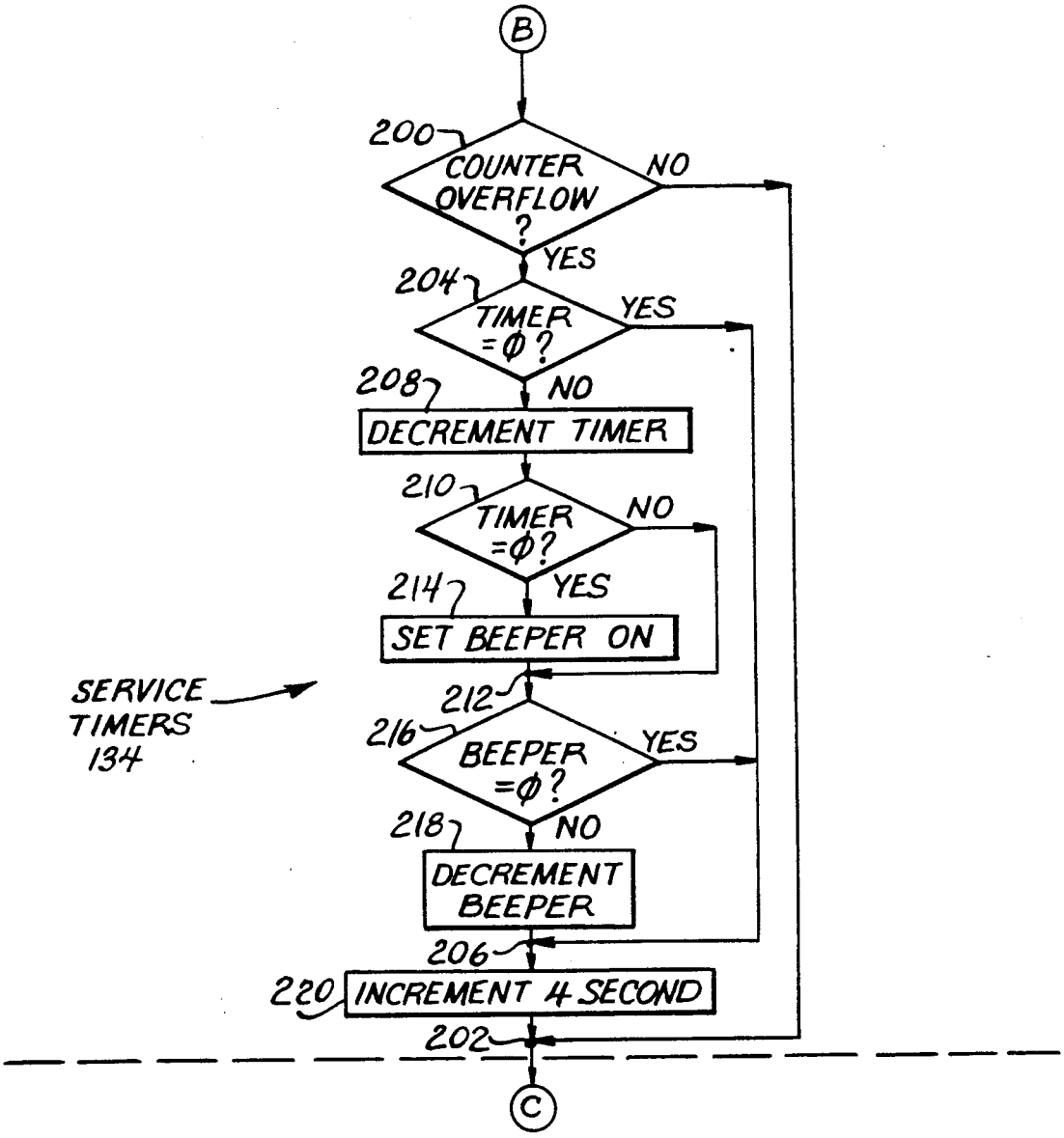
FIGS. 7 and 7*a* are software flowcharts of the Main Loop of the operational software of the preferred embodiment of this invention.
Figure 7B:
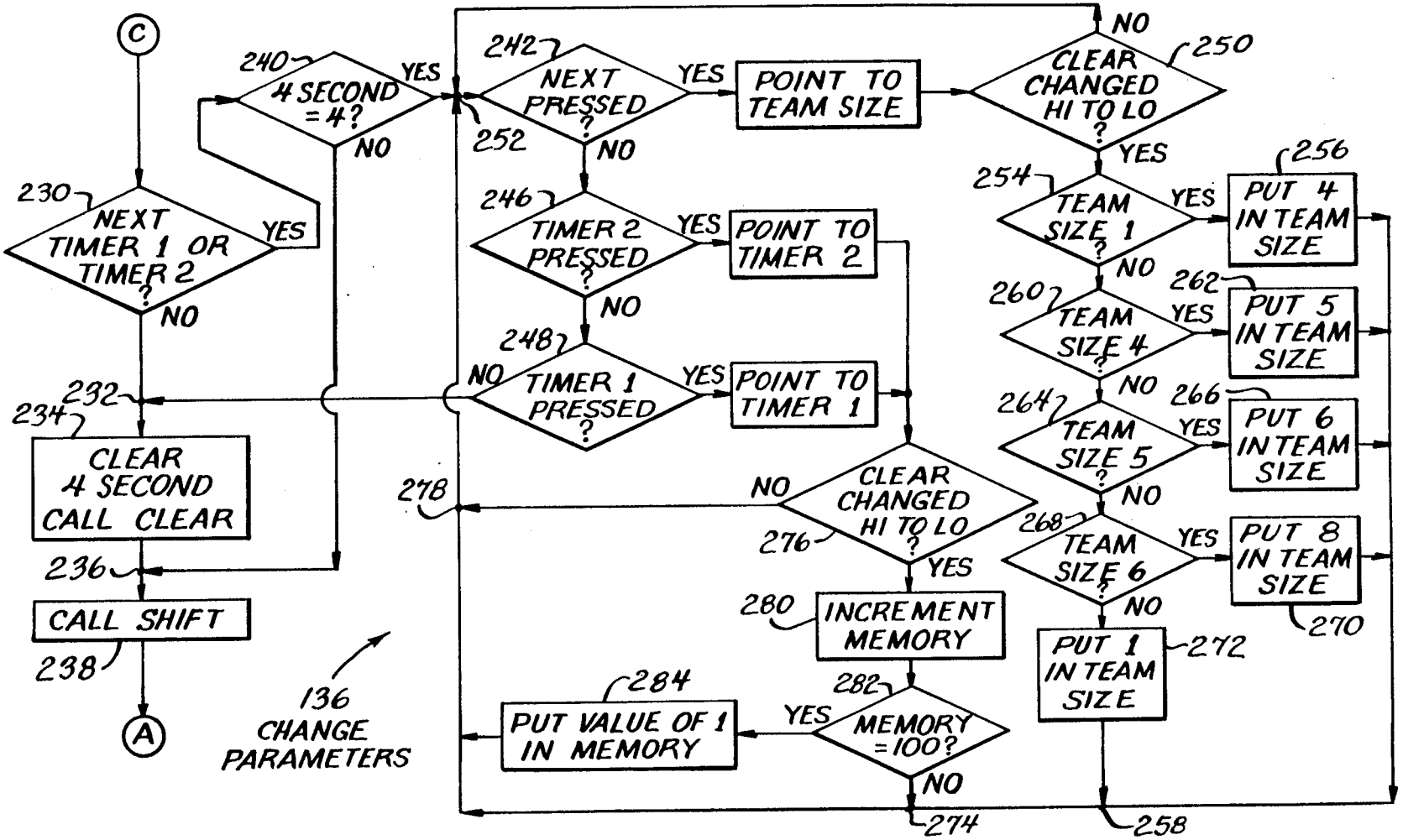

The system software in the preferred embodiment comprises a main loop (with an initialization section), a shift subroutine, a sort subroutine, and a clear subroutine. The main loop, as will be described in connection with FIGS. 7 and 7A, is the "normal" or "general" procedure followed by the system software. The shift subroutine, as will be described in connection with FIG. 8, generally scans the 32 player inputs, in the preferred embodiment, and develops a time-ordered list of contestants. The sort subroutine, as will be described in connection with FIG. 9, reviews the data stored by the shift subroutine, and causes the number of the player or the team who may attempt to answer the question to be displayed. The clear subroutine, as will be described in connection with FIG. 10, clears the memory and is generally run during initialization and between questions.

Main Loop

Turning now to FIGS. 7 and 7A, the main loop is shown. The main loop generally comprises in the preferred embodiment a check control button subsection 130, a refresh digit subsection 132, a service timer subsection 134, and a change parameter subsection 136. There is also an initialization section 138, which only runs upon power up, in the preferred embodiment.

Initialization

When the system is plugged in or alternatively switched on, the system software immediately starts initialization, as is known in the art. First, the microprocessor's data ports are initialized, as known in the art, and all of the data memory storage locations, as described above, are initialized. The memory storage location are set to default values, as known in the art. Team size is set to 4, the value of timer one is set to ten seconds and the value of timer two is set to five seconds, in the preferred embodiment. "Entry" and "Display" are set to 'one'. The remaining RAM is set to zero.

Check Control Buttons

The first subsection 130 of the main loop checks the control buttons and controls the game accordingly. In box 140 the key input port is read. In decision diamond 142, a test is made whether the Timer 1 control button is pressed. If it is, in box 144 the value in TIM1 is loaded into Timer and the program then jumps to connection point 146. If Timer 1 is not pressed in decision diamond 142, then the program continues in decision diamond 148 to check whether the Timer 2 control button is pressed.

If Timer 2 is pressed, then in box 50 Timer is loaded from the value stored in TIM2 and the program continues to connector 146. If the Timer 2 button is not pressed in decision diamond 148, then a check is made in decision diamond 152 whether the Clear button is pressed. If the Clear button is pressed, then in box 154 the Clear subroutine is called, as will be discussed in connection with FIG. 10.

When the Clear subroutine returns, the program continues to connector 146. If the Clear button is not pressed in decision diamond 152, then in decision diamond 156 a check is made if the Next button is pressed. If the Next button is pressed, in box 158 the Sort subroutine is called, as will be described in connection with FIG. 9 below. The program then continues at connector 146.

Refresh Digits

After connector 146 the program proceeds to the refresh digit subsection 132. In this subsection, the bit pattern in port 2 is checked to see which digit (of the 6 digit displays) is currently on (a logical low or 0). A check is made in decision diamond 160 whether digit 1 is on. If digit 1 is on, then the program in box 162 turns off digit 1 and turns on digit 2. The program then continues to connector 164. If digit is not on in decision diamond 160, then a check is made if digit 2 is on in decision diamond 166. If digit 2 is on, then in box 168 digit 2 is turned off and digit 3 is turned on, and the program continues to connector 164. If digit 2 is not on in decision diamond 166, then a test is made in decision diamond 170 whether digit 3 is on.

This program continues in this manner through digit 6. A test is made in decision diamond 182 if digit 6 is on. If digit 6 (the last digit) is on, the program then in box 184 turns off digit 6 and turns on digit 1. The program continues through connector 164 which leads to connector B of FIG. 7A.

Service Timers

Turning now to FIG. 7A, the program continues through connector B and proceeds to the service timer subsection. In the service timer subsection, the microprocessor's counter is tested for overflow. A count is kept of the number of overflows and, after 40, which corresponds to one second, various times are incremented or decremented. A test is made in decision diamond 200 whether the microprocessor's hardware counter overflowed, as discussed above. If the counter has not overflowed, then the program continues to connector 202.

If the counter overflowed, then a check is made in decision diamond 204 if the value in the storage location timer is equal to zero. If the value in the timer is equal to zero, then no timer is active and the program continues to connector 206. If the value in the timer is not equal to zero in decision diamond 208, then the value in Timer (memory location 22) is decremented by one in box 208.

A check is made in decision diamond 210 whether the value in timer is now equal to zero. If the value in the timer is not equal to zero, then the program continues through connector 212. If the value in the timer is equal to zero in decision diamond 210, then the timer has reached zero and the beeper is turned on in box 214 by writing a positive value into the BEEP storage location, and writing the proper bit pattern to port 1 as is known in the art.

The program continues through connector 212. A test is made in decision diamond 216 if the value in Beep is equal to zero. If the value in Beep is equal to zero, then the program continues through connector 206, and the beeper is turned off by writing the proper value to Port 1. If the beeper is not zero as determined in decision diamond 216, then in box 218 the value in the Beep is decremented by one. The program continues through connector 206. In box 220 the value in 4 sec (memory location 23) is incremented. The program continues through connector 202 into the change parameter subsection 136 of the main loop.

Change Parameters

The first test in the change parameter subsection 136 is in decision diamond 230 which determines whether any of the control pushbuttons are pressed. If none of the control pushbuttons are pressed, then the program continues through connector 232, clears the value in 4 sec by setting it equal to zero lock and calls the clear subroutine (as will be described in FIG. 10) in box 234. The program then continues through connector 236, and calls the shift subroutine in box 238. The program continues to connector A which connects it back to the top of the main loop at connector A in FIG. 7.

If in decision diamond 230 one of the three control push buttons is pressed, then the program proceeds to decision diamond 240 and the memory location 4SEC is checked to see if four seconds has been reached by comparing the value in 4 sec to 4. If not, the program proceeds through connector 236 and proceeds as above. If four seconds has been reached in decision diamond 240, then the moderator has held down one of the three control pushbuttons for four seconds, and wished to change the variable parameters.

The program, through decision diamonds 242, 246 and 248 determines which of three control buttons has been pressed. If the "next" button has been pressed as determined in decision diamond 242, then the moderator wishes to change the team size. In decision diamond 250 a test is made to see if the clear pushbutton is pressed. The clear control pushbutton is pressed by the moderator in conjunction with one of the other control pushbuttons in order to change the value in any of the variable memory locations. If the clear button has not been pressed in decision diamond 250, the program loops to connector 252.

If the clear pushbutton is pressed in decision diamond 250 then the program continues to decision diamond 254 where variable TM size is checked for equality with one.

In this embodiment of this invention, the team size may be 1 individual player, 4 per team, 5 per team, 6 or 8. If the team size currently equals 1 then the next team size is 4. Therefore, in decision diamond 254 if team size equals 1, then 4 is placed in team size in box 256 and the program continues to connector 258. If team size were not equal to 1 in decision diamond 254, then in decision diamond 260 team size is checked for equality with 4. If the team size is 4, then the program continues to box 262 where 5 is put in the team size storage location. The program then continues to connector 258.

If team size is not 4 in decision diamond 260, then in decision diamond 264 team size is checked for equality with 5. If the team size were 5 in decision diamond 264, then the program continues to box 266 where 6 is put in the team size and the program continues to connector 258. If the team size were not 5 in decision diamond 264, then the team size is checked for equality with 6 in decision diamond 268. If the team size is 6, then 8 is put in the team size in box 270 and the program continues to connector 258. If the team size were not 6 in decision diamond 268, then 1 is placed in team size in box 272. The program then proceeds through connector 258 and connector 274 and loops back to connector 252.

If the "next" control button is not pressed in decision diamond 242, then a check is made to determine if the timer 2 button is pressed in decision diamond 246. If timer 2 is pressed, then a test is made in decision diamond 276 to determine if the clear control push button is pressed. If not, then the program proceeds through connector 278 back to 252. If clear is pressed in decision diamond 276, the value in the TIM2 memory location is incremented by 1 in box 280. In this way, each time the "Timer 2" button is pressed (for less than 4 seconds) the new value of TIM2 is moved to Timer and displayed on the rear digits.

A test is then made in decision diamond 282 if the memory in the Tim2 is equal to 100. If not, the program proceeds to connector 274 and loops back to 252. This loop may be repeated as many times as necessary so that the timer value may be variously changed from one second to 99 seconds. If more time is desired, then the value of 100 may be changed in the software. If in decision diamond 282 the value in timer equals 100, then, in box 284, 1 is put into timer.

If the timer 2 control button is not pressed in decision diamond 246 then a test is made in decision diamond 248 to determine if the timer 1 control program were pressed. If timer 1 were not pressed, then the program loops through connector 232. If the timer 1 control pushbutton is pressed, then a test is made in box 276 to determine if the clear control pushbutton is pressed. If not, the program loops back to connector 278. If the clear control button is pressed, then the memory in timer 1 is incremented by 1 and the test for equality to 100 is made, as described above. If the value in TIM1 is equal to 100, then in box 284 1 is placed in TIM1.

The changed parameter section repeats until the moderator has set the desired parameters. This is determined when all three tests in decision diamonds 242, 246, and 248 are "no," meaning no control pushbuttons are currently pressed. The program proceeds as described above to connector 232 and eventually through connector A. The main loop continues to loop until the power is removed.

SUBROUTINES

Shift Subroutine

Figure 8:
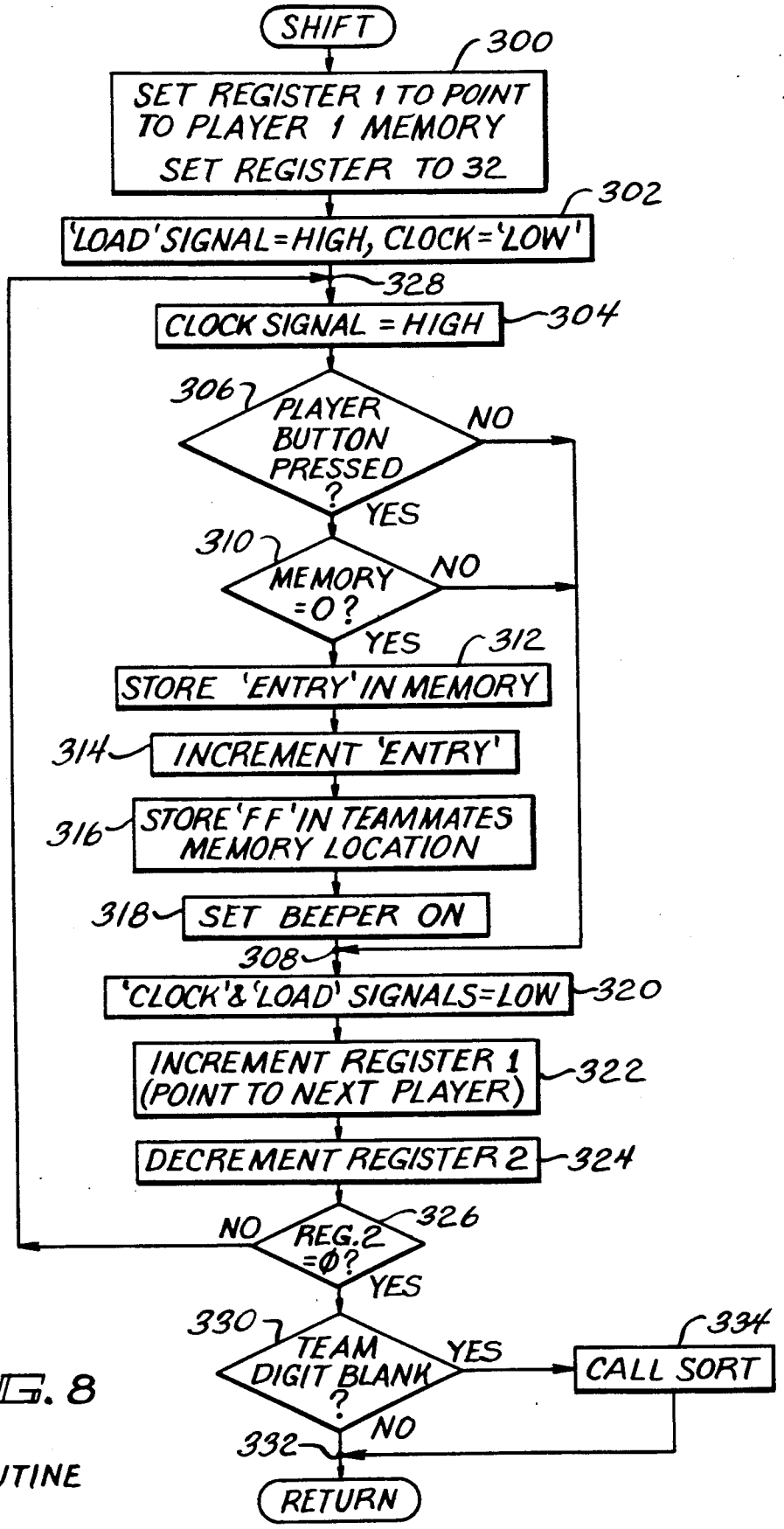
FIG. 8 is a software flowchart of the shift subroutine of the operational software of the preferred embodiment of this invention.

Turning now to FIG. 8, a flow chart for the shift subroutine is shown. In general, the shift subroutine scans the contestant pushbuttons and determines which contestant pushbutton was pushed first, which was second, etc. The shift subroutine is coordinated in timing with the load signal generated by the microprocessor and the clock signal. The shift subroutine waits for the load signal and the clock signal to both go high, and then reads the data port with each clock signal pulse.

As the clock signal pulse goes high, another bit representing the state of a contestant pushbutton is available at the data port. The shift subroutine initially sets a register to point to the first contestant's memory location and increments the contents of the register by one every clock pulse. This subroutine keeps track of the number of players in this embodiment by setting a second register to the maximum number of contestants (32 in the preferred embodiment), decrements the contents of the register every clock pulse, and exits the subroutine when the value in the second register reaches zero.

The shift subroutine uses the variable "Entry", described above in connection with FIG. 6, to keep track of the number of contestants who have pressed their respective contestant pushbuttons. When the game is initialized or the Clear subroutine runs, Entry is set to one. When a contestant pushbutton is found to be pressed, that is, when the shift subroutine finds a logical 1 or high at the data input in port 1, the value in Entry is transferred to the player's memory location pointed to by register 1, and Entry is incremented.

To this end, in box 300 of the shift subroutine, according to the preferred embodiment, register 1 of the microprocessor's general purpose registers is set to point to player one's memory location which, in this embodiment, is location 32. Register 2 is set to 32, the maximum number of players, and is used as an iteration counter. In box 302, the program waits until the load signal is high and the clock signal is low. In box 304, the program again waits until the clock signal is high. When the clock signal is high in box 304, a bit is available at the microprocessor's data input as described above in connection with FIG. 3. This bit corresponds to whether player one's contestant pushbutton is pushed or not.

The data port (port 1) is read, and, if there is no data in the data port in decision diamond 306, then that contestant has not pressed his or her contestant pushbutton and the program jumps to connector 308. If there is data present at the data port then the contestant has pressed his or her contestant pushbutton and the program continues to decision diamond 310. In decision diamond 310, the memory that is pointed to by register 1 (which corresponds to the contestant pushbutton being read at the data port) is checked to see that the contents of the memory pointed is a zero value. If there is a nonzero value in the memory, then either that player's pushbutton already had an order number assigned to it, or another member of the team has already had an order number assigned to it.

As a result, the program jumps to connector 308. If the value in memory equals zero in decision diamond 310, then the program stores the order number in the "Entry" memory location into the memory location pointed to by register 1 in box 312. If the team size is greater than 1, then in box 316 the program stores "FF" in the memory locations for the teammates, depending upon the team size. In box 318 the beeper is set to On, that is, a positive value is put in the "Beep" memory location and the appropriate bit value is written to port 1, which indicates a first player has been found. The program then continues through connector 308.

Following connector 308, the program waits until the clock and load signals are low in box 320. After the clock and load signals are low in box 320, register 1 is incremented in order to point to the next player's memory location and in box 324 register 2 is decremented. In decision diamond 326, register 2 is checked for a zero value, meaning that all of the contestant pushbuttons have been checked. If register 2 is nonzero, then the program loops back to connector 328.

If the register 2 is zero, then all 32 player pushbuttons (in the preferred embodiment) have been scanned. The program then in decision diamond 330 checks if there is a value in the team digit (disp0) memory location. If there is a value in it, then the program continues through connector 332 and returns. If there is not a value in it, then the program has found a "first" contestant and calls the sort subroutine in box 334, which will be described in connection with FIG. 9 below. The program continues to connector 332 and finally returns to the program point at which it was called.

Sort Subroutine

Figure 9:
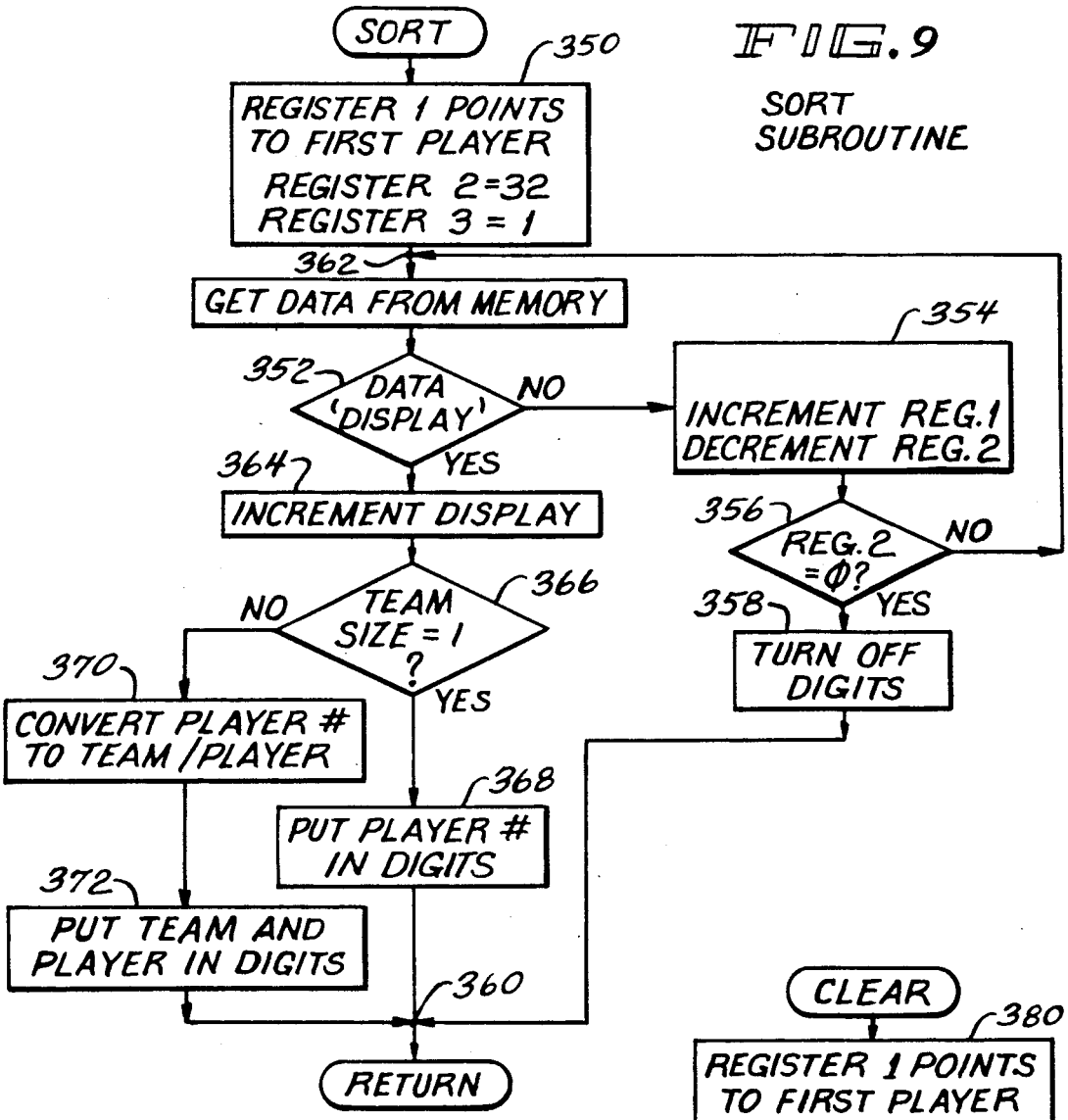
FIG. 9 is a software flowchart of the sort subroutine of the operational software of the preferred embodiment of this invention.

Turning now to FIG. 9, a flow chart for the Sort subroutine is shown. In general, the Sort subroutine scans the player memory area looking for the next player to display, that is, the next player that may attempt to answer the question. To this end, the sort subroutine is generally a loop. This subroutine uses the variable "Display" as described above in connection with FIG. 6, to store the order number of the player to be displayed next. For example, if the first player is being displayed, "2" would be stored in "display." Each time sort is called, it scans all player memory locations (32–63) comparing the values in each memory location with the value in "Display." If there is a match, then the player number corresponding to that memory location is displayed on the front 42 and rear 58 digital displays.

To this end, first, in box 350, register 1 is set to point the memory location for the first player (memory location 32). Register 2 is set to 32. In decision diamond 352, a test is made to determine if the value stored in a player's memory location equals the value in Display pointed to by register 1 (the next player to display). If the values are not equal, then in box 354 register 1 is incremented by one and register 2 is decremented by one. A test is then made to determine if register 2 equals zero in decision diamond 356. If register 2 equals zero in decision diamond 356, then in box 358 the display 42 and 58 digits are turned off by writing a logical high ("ff") into the digit display memory location DIG1. The program proceeds to connector 360 and the program returns. If register 2 is not equal to zero in decision diamond 356, then the program loops back to connector 362 and proceeds to retrieve the value stored in the next player's memory location.

If the value in the player's memory location pointed to by a register does equal the value in Display (the next player to display) in decision diamond 352, the value in Display is incremented by one in box 364, and, in decision diamond 366, a check is made of the value in TMsize (team size). If the team size is equal to one, then in box 368 the player number from register 1 is written into DISP1, which will then be displayed on digit displays 42 and 58. The program then proceeds to connector 360 and returns.

If the team size does not equal one in decision diamond 366, then in box 370 the player number is converted to the team/player number. In box 372, the team and the player number is put into the display digits DISP1 and that value is displayed as described above. The program then proceeds to connector 360 and returns.

Clear Subroutine

Figure 10:
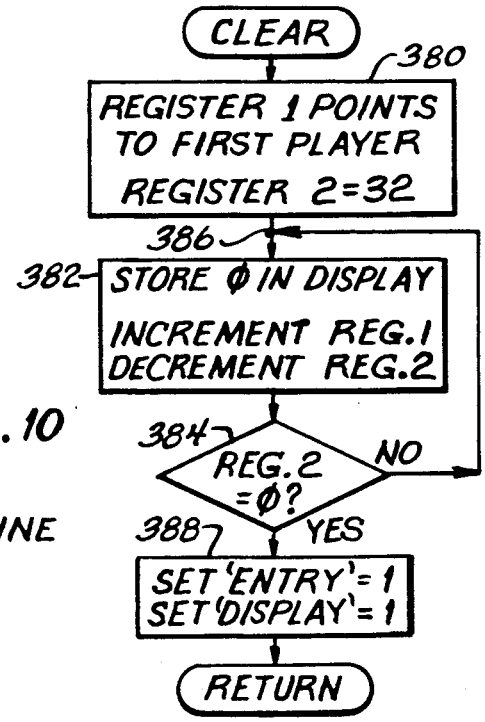
FIG. 10 is a software flowchart of the clear subroutine of the operational software of the preferred embodiment of this invention.

Referring to FIG. 10, in general, the Clear subroutine clears the player memory locations, sets the value stored in the "Entry" and "Display" memory locations to one, and turns off the digit display 42 and 58. First, in box 380, the clear subroutine sets register 1 to point to the first player's memory location and sets register 2 to 32. The program then proceeds to box 382 where zero is stored in the memory location pointed to by register 1. In box 382, register 1 is incremented by one and register 2 is decremented by 1.

In decision diamond 384 a check is made to see if register 2 equals zero. If register 2 does not equal zero in decision diamond 384, then the program loops back to connector 386. If register 2 does equal zero, then all 32 entries have been set to zero and the program proceeds to box 388. In box 388 entry is set to one which resets the first player and display is set to one which turns off the display. The program then returns.

This invention has been described in connection with the preferred embodiment. The preferred embodiment of this invention is a game. However, other applications could use this invention without departing from the scope.

We claim:

1. An academic quiz controller apparatus for developing a time-ordered list of a plurality of responses, said apparatus comprising:

a signal line;

a plurality of response means, each of said response means developing a signal in response to a manual input and delivering said signal to the signal line;

a signal processing means for receiving said signals from said signal line and developing the time-ordered list by repetitively determining if one of said plurality of response means developed a signal during a predetermined time period;

a display means operatively connected to said signal processing means for displaying said time-ordered list.

2. The quiz controller apparatus of claim 1 further including a control means operatively connected to said signal processing means to provide control of said signal processing means.

3. The quiz controller apparatus of claim 1 wherein: said signal processing means includes timer means for timing said predetermined time period.

4. The quiz controller apparatus of claim 2 wherein said signal processing means includes two timers controlled by said control means and displayable by said display means.

5. The quiz controller of claim 1 wherein contestants may compete individually or may compete in teams.

6. The quiz controller of claim 5 wherein the team size is variable from 2 to 8 contestants per team.

7. The quiz controller of claim 5 wherein the team size is greater than 8 contestants per team.

8. The quiz controller of claim 1 wherein said signal processing means comprises a microprocessor.

9. The quiz controller of claim 1 further including a memory means operatively connected to said signal processing means, said signal processing means storing the time-ordered list in said memory means.

10. The quiz controller of claim 1 wherein said signal processing means causes the time-ordered list to be displayed on said display means one entry at a time.

11. The quiz controller of claim 1 wherein the number of contestants is variable.

12. An academic quiz controller apparatus for developing a time-ordered list of a plurality of contestant responses, said contestant responses being in response to a question asked by a moderator, said quiz controller comprising:

a plurality of contestant pushbuttons manually operated by said contestants for indicating a desire to answer said questions, each of said contestant pushbuttons developing an electronic signal in response to being operated;

at least one player interface operatively connected to said contestant pushbuttons, said player interface receiving said contestant pushbutton signals in parallel and developing a serial electronic signal in response thereto; and a main unit operatively connected to said player interface, said main unit receiving said serial signal and determining therefrom a time-ordered list of contestant responses, said main unit further including a visual display for displaying said time-ordered list of visual display for displaying said time-ordered list.

13. The academic quiz controller of claim 12 including memory means for storing said time-ordered list, said memory means being operatively connected to said main unit.

14. The academic quiz controller of claim 12 wherein said visual display displays said time-ordered list one entry at a time.

15. The academic quiz controller of claim 12 wherein said plurality of contestants may compete against each other individually or in teams.

16. The academic quiz controller of claim 15 wherein said teams may comprise 2 to 8 contestants each.

17. The academic quiz controller of claim 16 wherein said teams may comprise more than 8 contestants each.

18. The academic quiz controller of claim 12 further including manual input controls operatively connected to said main unit whereby said moderator may control the operation of said main unit.

19. The academic quiz controller of claim 18 wherein said main unit includes a timer for timing responses to said question, controlled by said manual input controls.

20. The academic quiz controller of claim 19 wherein the main unit includes two timers selectably by said manual input controls and which are displayed by said display.

21. The academic quiz controller of claim 18 wherein said manual input controls may clear the system.

22. A method of controlling an electronic game, said electronic game comprising a plurality of response units, each of said response units generating a signal when activated, said plurality of response units connected to a control unit via a signal line, said method including the steps of:

a. said signal line receiving a signal generated by one of said plurality of response units during a predetermined time, b. said control unit receiving said signal from said signal line and determining said one of said response units that generated said signal during said predetermined time, c. repeating steps a. and b. for a predefined time, and d. developing a time-ordered list of ones of said response units that generated a signal during said predefined time.

23. A method according to claim 22 wherein said signal line comprises one or more latching parallel to serial shift registers under the control of said control unit, wherein said step of said control unit receiving said signal comprises latching said signal line after said predetermined time and serially shifting said signal line into said control unit.

24. A method according to claim 23 wherein said control unit includes an incrementing number counter, wherein said step of determining the response unit comprises incrementing said counter each time said signal line is shifted, wherein said number is said counter when said signal is received in said control unit corresponds to the response unit that generated said signal.

* * * * *